US006644246B1

(12) United States Patent
Cwik et al.

(10) Patent No.: US 6,644,246 B1
(45) Date of Patent: Nov. 11, 2003

(54) EVAPORATOR

(75) Inventors: Roland Cwik, Augsburg (DE); Andreas Ebert, Kirchheim/Teck (DE); Oskar Lamla, Bissingen a.d. Teck (DE); Martin Schuessler, Ulm (DE); Tomas Stefanovski, Boeblingen (DE)

(73) Assignee: Ballard Power Systems AG, Kirchheim/Teck-Nabern (DE)

( * ) Notice: Subject to any disclaimer, the term of this patent is extended or adjusted under 35 U.S.C. 154(b) by 221 days.

(21) Appl. No.: 09/662,848

(22) Filed: Sep. 15, 2000

(30) Foreign Application Priority Data

Sep. 15, 1999 (DE) ..... 199 44 184
Oct. 6, 1999 (DE) ..... 199 47 923

(51) Int. Cl.[7] ..... F22B 1/00
(52) U.S. Cl. ..... 122/4 D; 122/4 R
(58) Field of Search ..... 122/4 D, 367.1, 122/4 R, 5.51, 5.52

(56) References Cited

U.S. PATENT DOCUMENTS 3,364,071 A * 1/1968 Kordesch ..... 429/34
3,480,538 A * 11/1969 Sturm ..... 204/290.01
4,069,005 A 1/1978 Palani ..... 431/4
4,089,303 A 5/1978 Brulfert ..... 122/250 R
4,273,560 A 6/1981 Kostka ..... 48/212
4,388,892 A 6/1983 Rody et al. ..... 122/4 D
4,693,868 A 9/1987 Katsuda et al. ..... 422/124
4,795,618 A 1/1989 Laumen ..... 422/202
5,823,252 A 10/1998 Waitkat et al. ..... 165/166
6,152,216 A 11/2000 Schwab et al. ..... 165/167

FOREIGN PATENT DOCUMENTS

| | | |
|---|---|---|
| DE | 33 90 229 | 10/1984 |
| DE | 37 29 114 | 3/1989 |
| DE | 44 26 692 | 9/1995 |
| DE | 197 20 294 | 12/1998 |
| DE | 197 43 673 | 4/1999 |
| DE | 198 32 625 | 2/2000 |
| DE | 198 47 213 | 2/2000 |

* cited by examiner

*Primary Examiner*—Jiping Lu
(74) *Attorney, Agent, or Firm*—Crowell & Moring LLP

(57) ABSTRACT

A device for evaporating liquids includes a porous, thermally conductive evaporation body, which contains a catalyst material on one surface, while the evaporation body is gas-impermeable on the opposite surface. Liquid which is to be evaporated and, if appropriate an additional fuel, can be fed to the evaporation body. The heat of evaporation required is provided by an exothermic reaction of the liquid or with a gaseous oxidizing agent at the catalyst material.

6 Claims, 1 Drawing Sheet

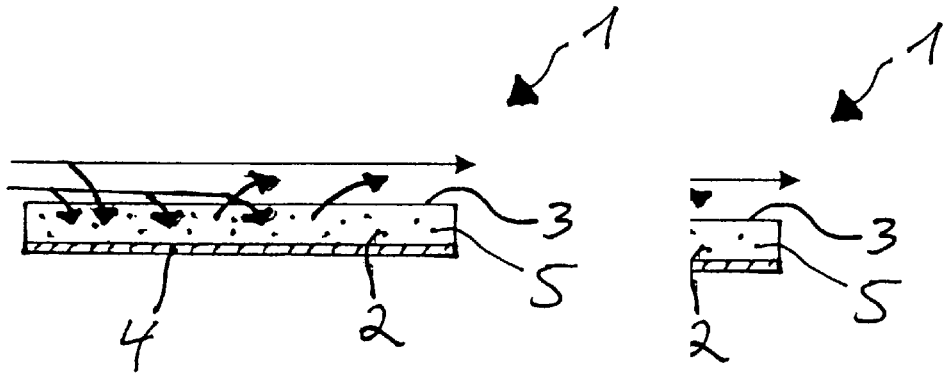
Fig. 2
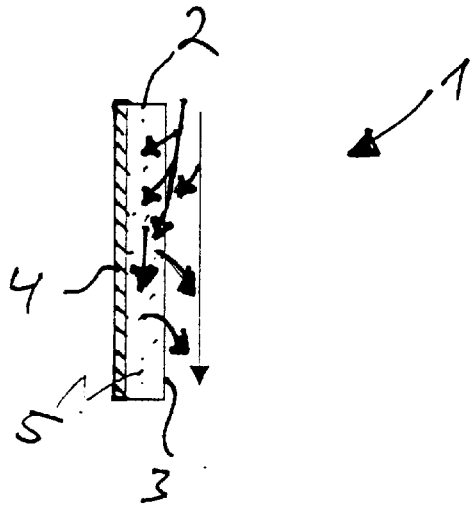
Fig. 3
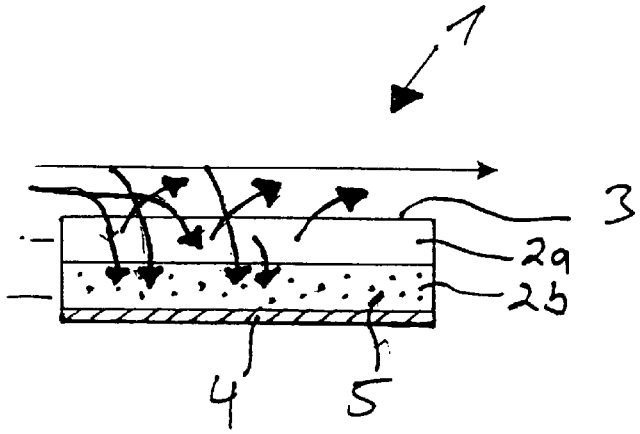

EVAPORATOR

BACKGROUND AND SUMMARY OF INVENTION

This application claims the priority of German patent documents 199 44 184.7, filed Sep. 15, 1999 and 199 47 923.2, filed Oct. 6, 1999, the disclosures of which are expressly incorporated by reference herein.

The present invention relates to a device for evaporating liquids.

A two-stage evaporator unit in the form of a plate heat exchanger is known from DE 44 26 692 C1, in which heat exchanger plates alternate with evaporator spaces and heat-transfer spaces. The required heat of evaporation is introduced into the heat-transfer spaces with the aid of a heat-transfer medium, for example a hot heat-transfer oil. Furthermore, it is known for the heat to be generated directly in the heat-transfer spaces by catalytic conversion of a fuel.

DE 197 20 294 C1 discloses a reformer reactor with an evaporator. The reactor comprises an evaporation body which adjoins the reaction zone with surface-to-surface contact and has a porous, thermally conductive structure for providing the gas mixture which is to be reformed by mixing and evaporating the gas mixture components which are fed to it.

The object of the present invention is to provide an evaporator which is improved in terms of mass, volume, dynamics and thermal stresses.

This object is achieved by a device according to the present invention.

Designing an evaporator in the form of a porous evaporation body over which gas flows and which is directly catalytically heated has considerable advantages with regard to mass, volume, and cost. For example, it is possible to dispense altogether with the need to form additional spaces for providing the required evaporation energy. The design as a large-area layer over which gas flows allows the evaporator to be integrated in known plate-type reactors. The porous body forms a highly wettable surface which ensures that heat is introduced successfully into the liquid. Due to the porous structure, the mechanical stresses which occur during evaporation are lower than, for example, with a planar, solid metal sheet.

The vertical arrangement of the surfaces and the introduction of the liquid to be evaporated in an upper region of the evaporation body has the advantage that the force of gravity can be utilized to disperse the liquid to be evaporated inside the evaporation body. Splitting the evaporation body into an upper evaporation layer and a lower heating layer has the advantage that the pores of the catalyst material cannot fill up with liquid, which would impair operation of the device.

To produce an evaporation body, the catalyst material is advantageously pressed into a support structure. Dendritic copper powders are particularly suitable for the support structure, which powders can easily be compressed or sintered to form a mesh even if the copper powder forms a relatively low proportion of the total mass of the layer, have a large surface area and are themselves catalytically active. Therefore, the use of dendritic copper powder results in a stabilizing, fixing and heat-distributing mesh in the micrometre range.

Other objects, advantages and novel features of the present invention will become apparent from the following detailed description of the invention when considered in conjunction with the accompanying drawings.

BRIEF DESCRIPTION OF THE DRAWINGS

FIG. 1 shows a first embodiment of an evaporator according to the present invention;

FIG. 2 shows a second embodiment of an evaporator according to the present invention utilizing the force of gravity; and FIG. 3 shows a third embodiment of an evaporator according to the present invention, with an evaporation body which is divided into an evaporation layer and a heating layer.

DETAILED DESCRIPTION OF INVENTION

The device for evaporating liquids, which is denoted overall by 1 and is referred to below as evaporator for short, contains a porous, thermally conductive evaporation body 2. A gaseous oxidizing agent, preferably air or oxygen, flows over at least one surface 3 of the evaporation body 2. On the opposite surface from the surface 3, the evaporation body 2 has a gas-impermeable layer 4. Furthermore, the evaporation body 2 contains a catalyst material 5 which is diagrammatically illustrated as dots.

The liquid to be evaporated is fed to the surface 3 of the evaporation body 2. The required evaporation energy is provided by an exothermic reaction of a fuel with the oxidizing agent which diffuses into the evaporation body 2 at the catalyst material 5 contained therein. The fuel may be the liquid to be evaporated itself. Alternatively, however, it is also possible to supply an additional fuel, either in liquid or partially or completely in gas form. Since the evaporation body 2 has a gas-impermeable layer 4 on the surface opposite to the surface 3, the gas which is formed flows back into the oxidizing agent flowing over the evaporation body 2 and is removed from the evaporator 1 together with this agent.

Preferably, the evaporation body 2 has macropores of a size in the range from 0.1 to 10 $\mu$m. It may preferably be produced by pressing catalyst material 5 into a thin, highly compressed layer with a large surface area. To provide the catalyst material 5 with improved mechanical stability and/or improved thermal conductivity, it is possible for the catalyst material 5 to be pressed into a support structure. This support structure is preferably a mesh-like matrix which can be produced by mixing the catalyst material 5 with a metal powder and then compressing this mixture.

Dendritic copper powders are particularly suitable for the support structure, which powders can easily be compressed or sintered to form a mesh even when the copper powder forms a relatively low proportion of the total mass of the layer, have a large surface area and are themselves catalytically active. Therefore, the use of dendritic copper powder results in a stabilizing, fixing and heat-distributing mesh in the micrometre range. The production of a porous body containing catalyst material of this type is known, for example, from DE-A-19743673.

The porous evaporation body 2 forms a highly wettable surface which ensures that heat is successfully introduced into the liquid. Due to the porous structure, the mechanical stresses which occur during evaporation are lower than, for example, in a planar, solid metal sheet.

The liquid to be evaporated may be introduced into the evaporator 1 at any desired point. Alternatively, it is also possible for the liquid already to have been introduced into the stream of oxidizing agent upstream of the evaporator 1. Preferably, the liquid to be evaporated is sprayed onto the surface 3 of the evaporation body 2 with the aid of a spray nozzle. The drawing only illustrates the principle of the evaporator 1. However, it is within the scope of the person skilled in the art to provide a suitable housing with inlet and outlet lines for the media. Furthermore, it is also possible to form a stacked arrangement from a plurality of evaporation bodies 2, as is generally known from reactor engineering and, specifically for compressed catalyst discs, from patent application DE 198 32 625.4, which is not a prior publication. Furthermore, it is possible to join an evaporation body 2 with other compressed catalyst layers which are suitable for carrying out other catalytic reactions to form an overall system in the form of a plate-type reactor. An overall system of this type produces, for example, a gas-generation system for fuel cell units, in which a hydrogen-rich gas for use in fuel cells is produced from a hydrogen-containing crude fuel. Particularly for mobile applications, high demands are imposed with regard to mass, volume, costs, and dynamics. These demands can be fulfilled more successfully by an evaporator according to the present invention.

The functioning of the evaporator 1 described can advantageously be improved by utilizing the force of gravity. Specifically, in the arrangement illustrated in FIG. 1, the liquid supplied is guided from the surface 3 into the evaporation body 2 under the force of gravity. The hot and therefore lighter gas which is formed in the evaporation body then flows towards the surface 3, counter to the force of gravity, and, in the process, transfers thermal energy to the liquid flowing in.

Even better utilization of the force of gravity is possible with the arrangement shown in FIG. 2. In this arrangement, in an operating position of the evaporator 1 the surface 3 and the gas-impermeable layer 4 extend in the vertical direction. The gaseous oxidizing agent is also guided vertically from the top downwards. The liquid to be evaporated is likewise applied to the surface side 3 in an upper region. Consequently, the liquid fractions which have not yet evaporated are guided downwards inside the evaporation body 2 by the force of gravity. As a result, the effective path of the liquid to be evaporated inside the evaporation body 2 is lengthened. Once again, the gas formed during the evaporation emerges from the surface 3, becomes mixed with the oxidizing agent stream and is removed from the evaporator 1 together with this agent.

FIG. 3 shows another preferred exemplary embodiment. In this case, not all of the evaporation body 2 is provided with catalyst material 5, but rather the evaporation body 2 is divided into two layers 2*a* and 2*b*. Both layers 2*a*, 2*b* are of porous design. However, the layer 2*a* which is formed adjacent to the surface 3 as an evaporation layer does not contain any catalyst material 5, unlike the layer 2*b* which is adjacent to the gas-impermeable layer 4. In this case, the layer 2*b* serves as a catalytic heating layer in which the oxidizing agent and the fuel are converted to generate the thermal energy required. The heat is then transferred by thermal conduction from the heating layer 2*b* to the adjacent evaporation layer 2*a*. Secondly, the converted gas flowing out of the heating layer 2*b* also exchanges heat with the liquid supplied and/or the additional fuel and thus likewise contributes to the heating or evaporation. Dividing the evaporation body 2 into two layers 2*a*, 2*b* prevents the pores of the catalyst material 5 from filling up with liquid so that the functioning is impaired. This is because in this case, due to the evaporation taking place upstream in the direction of flow, essentially only gaseous media enter the heating layer 2*b*.

A preferred example of an application for an evaporator according to the present invention is use in a gas-generation system for mobile fuel cell units. As has been explained above, in a gas-generation system of this type, a hydrogen-rich gas for use in fuel cells is produced from a hydrogen-containing crude fuel. The oxidizing agent fed to the evaporator 1 is oxygen, preferably in the form of ambient air. The hydrogen-containing crude fuel used is preferably methanol. However, it is also possible to use any other desired fuels, in particular hydrocarbons. In this case, the liquid to be evaporated can at the same time also be used as fuel for the evaporator 1. The evaporated methanol and the air emerge from the evaporator 1 and, in a downstream reforming stage, are converted to a hydrogen-rich gas by a partial oxidation reaction. Furthermore, it is also possible to use a water/methanol mixture instead of the methanol. In this case, autothermal reforming can be carried out in the downstream reforming stage. Naturally, it is also possible to provide separate evaporators 1 for the methanol and the water and for the gaseous media which emerge only to be mixed afterwards. In this case, however, an additional fuel would have to be added to the evaporator 1 for the water in order to generate the required heat of evaporation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for evaporating liquids comprising a porous, thermally-conductive evaporation body containing a catalyst material and having a gas-impermeable surface, said evaporation body being disposed in use to accept feeding thereto of a liquid to be vaporized such that the liquid flows from an upper region of the evaporator body into a lower region of the evaporator body under the force of gravity.

2. A device according to claim 1, wherein the evaporation body comprises:

a layer adjacent to a surface not containing any catalyst material; and a layer adjacent to the gas-impermeable surface containing the catalyst material.

3. A device according to claim 1, wherein the evaporation body has macropores of a size ranging from 0.1 to 10 m.

4. A device according to claim 1, comprising means for flowing a gaseous oxidizing agent over a first surface of the evaporation body which is opposite the gas impermeable surface, and means for feeding a liquid fuel over the surface of the evaporation body.

5. A device according to claim 4, comprising means for spraying the liquid fuel on to the surface of the evaporation body.

6. A device according to claim 4, wherein in an operating position, the first surface and the gas-impermeable surface of the evaporation body extend in a vertical direction, and the liquid is applied to the first surface in an upper region of the evaporation body and flows into a lower region of the evaporation body under the force of gravity.

* * * * *